US007731157B2

(12) United States Patent
Davidson

(10) Patent No.: US 7,731,157 B2
(45) Date of Patent: Jun. 8, 2010

(54) APPARATUS AND METHOD FOR HEAVE COMPENSATION

(75) Inventor: Daniel Davidson, Aberdeen (GB)

(73) Assignee: SUBSEA 7 Limited, London (GB)

( * ) Notice: Subject to any disclaimer, the term of this patent is extended or adjusted under 35 U.S.C. 154(b) by 707 days.

(21) Appl. No.: 10/593,531

(22) PCT Filed: Mar. 18, 2005

(86) PCT No.: PCT/GB2005/001141

§ 371 (c)(1),
(2), (4) Date: Dec. 13, 2006

(87) PCT Pub. No.: WO2005/090226

PCT Pub. Date: Sep. 29, 2005

(65) Prior Publication Data

US 2007/0272906 A1 Nov. 29, 2007

(30) Foreign Application Priority Data

Mar. 19, 2004 (GB) ..... 0406336.8

(51) Int. Cl.
*B66D 1/00* (2006.01)

(52) U.S. Cl. ..... 254/277; 405/200; 114/258

(58) Field of Classification Search ..... 254/275, 254/277, 274; 405/200, 219; 114/263, 258
See application file for complete search history.

(56) References Cited

U.S. PATENT DOCUMENTS 3,259,371 A * 7/1966 Goepfert et al. ..... 254/270
3,648,858 A * 3/1972 Barron et al. ..... 414/139.5
3,653,636 A * 4/1972 Burrell ..... 254/270
3,753,552 A * 8/1973 Barron ..... 254/270
3,946,559 A * 3/1976 Stevenson ..... 60/413
4,121,806 A * 10/1978 Iato et al. ..... 166/355
4,236,695 A * 12/1980 Morrison ..... 254/277
4,544,137 A * 10/1985 Johnson ..... 254/337
4,570,245 A * 2/1986 Thigpen ..... 367/15
4,828,430 A * 5/1989 van der Heyden ..... 405/209
5,140,927 A * 8/1992 Tolefson ..... 114/244
5,190,107 A * 3/1993 Langner et al. ..... 166/355

(Continued)

FOREIGN PATENT DOCUMENTS

DE 28 18 569 10/1979

(Continued)

*Primary Examiner*—Emmanuel M Marcelo
(74) *Attorney, Agent, or Firm*—Drinker Biddle & Reath, LLP

(57) ABSTRACT

A heave compensation apparatus and method for a winch or crane system, the winch or crane system preferably for a vessel and including a lift wire for attachment to a load. The apparatus includes a vessel motion measurement device which may be in the form of a motion reference unit for measuring the motion of the vessel, and a control device or computer capable of receiving an output from the vessel motion measurement device and controlling the winch or crane system according to the movement of the vessel, so as to stabilise the load. The apparatus may further optionally include one or more of a lift wire tension measuring device for measuring the tension in the lift wire; a lift wire distance measurement device which measures the length of lift wire that has been paid out; and a load motion measurement device for measuring the motion of the load.

40 Claims, 3 Drawing Sheets

U.S. PATENT DOCUMENTS

| | | | | |
|---|---|---|---|---|
| 5,507,596 | A * | 4/1996 | Bostelman et al. | 405/191 |
| 5,894,895 | A * | 4/1999 | Welsh | 175/5 |
| 6,068,240 | A * | 5/2000 | Leveugle | 254/277 |
| 6,216,789 | B1 * | 4/2001 | Lorsignol et al. | 166/355 |
| 6,505,574 | B1 | 1/2003 | Naud et al. | |
| 6,817,422 | B2 * | 11/2004 | Jordan | 166/381 |
| 6,926,260 | B1 * | 8/2005 | De Groot et al. | 254/277 |
| 2003/0107029 | A1 | 6/2003 | Hanson et al. | |
| 2005/0242332 | A1 * | 11/2005 | Ueki et al. | 254/277 |
| 2006/0074517 | A1 | 4/2006 | Schneider et al. | |

FOREIGN PATENT DOCUMENTS

| | | |
|---|---|---|
| GB | 2 252 295 | 8/1992 |
| JP | 01 153988 | 6/1989 |
| WO | WO 01/42126 | 6/2001 |
| WO | WO 02/27684 | 4/2002 |
| WO | WO 2004/106215 | 12/2004 |

* cited by examiner

APPARATUS AND METHOD FOR HEAVE COMPENSATION

FIELD OF THE INVENTION

The present invention relates to apparatus and a method that are particularly, but not exclusively, suited for deep-water heave compensation.

DESCRIPTION OF THE RELATED ART

It is common in the marine industry for loads to be lowered from a surface vessel to the seabed. The surface vessel is typically provided with a winch or crane that is capable of lowering a load to the seabed, or raising a load therefrom. As the vessel floats on the sea, the wave action of the sea causes vessel motions, which in turn cause motion of the top end of the lowering cable or rope. In particular, vertical motion of the top end of the cable or rope translates to an undesirable vertical motion of the suspended load.

Unwanted vertical motion of the suspended load creates two problems in the marine industry. Firstly, relative motion between the load and the surrounding water introduces additional loads into the system. Secondly, the uncontrolled vertical motion of the suspended load makes it difficult for an operator to be confident of positioning a load on the seabed, or other landing site, in a safe and damage-free manner. Thus, the load may be set down too heavily causing damage thereto.

Heave compensated cranes and winches are the common solution to these problems. A conventional heave compensated winch or crane includes a motion reference unit that monitors the motion of the vessel. The motion of the vessel is translated to the point from which the load and lowering rope are suspended, and thus the output from the motion reference unit can be used to monitor the motion of the point of suspension. The output from the motion reference unit forms a feedback loop to the control system that drives the winch or crane so that the vertical motion of the vessel caused by the waves can be compensated for. As a result, the point from which the load and lowering rope are suspended becomes nearly stationary. In practice however, it is not generally possible to compensate entirely for the heave of the vessel, and thus there is normally some small residual motion at the load. This motion is usually within acceptable limits for handling loads.

These conventional heave compensation systems generally work well in relatively shallow water (depths up to around a few hundred metres). This is because the lift wire is relatively short, and the wire acts as a stiff spring. The magnitude of any resonance in the system is therefore minimal and easily accommodated for by the operator of the winch or crane.

However, when working at depths beyond this, further difficulties arise, in particular, the elasticity inherent in the long hoist cable. This can induce motions in the load that are not directly related to the vessel motion and therefore load control based solely on the measurement of the latter is no longer adequate. Even in relatively shallow depths, resonant behaviour can still become a problem if a conventional (steel) lift wire cannot be used for whatever reason (e.g. for operational reasons, a fibre lift wire must be used).

BRIEF SUMMARY OF THE INVENTION

According to an initial aspect of the present invention, there is provided load movement control system for a winch or crane system located on a vessel, the winch or crane system including a lift wire, the load movement control system comprising:— a) a control means to permit an operator to instruct the winch or crane system to at least raise, hold or lower the lift wire;

b) a vessel motion detection means for detecting heave acting upon the vessel and winch or crane system;

c) lift wire resonance prevention means for measuring and/or predicting the tension in the lift wire; and a control device capable of receiving outputs from the a) operator control means, b) vessel motion detection and c) lift wire resonance prevention means and controlling the winch or crane system in response to said outputs.

According to the initial aspect of the present invention, there is also provided a method of controlling the movement of a load raised or lowered by a winch or crane system provided on a vessel, the winch or crane system including a lift wire, the method comprising the steps of:— a) providing an output from an operator control means which indicates if an operator instructs raising, holding or lowering of the lift wire;

b) providing an output indicative of heave acting upon the vessel and winch or crane system;

c) providing an output indicative of a prediction and/or measurement of resonance generated in the lift wire; and d) adjusting the pay out or recovery of the lift wire in response to the said outputs a) to c).

Typically, the method and apparatus according to the initial aspect comprises providing a control device including a computation means.

Optionally, the control device is further capable of receiving an output from a load movement device and is optionally further capable of controlling the winch or crane system in response to said output.

According to a first aspect of the present invention, there is provided heave compensation apparatus for a winch or crane system, the winch or crane system including a lift wire, the apparatus comprising:— a lift wire tension measuring device for measuring the tension in the lift wire;

and a control device capable of receiving an output from the lift wire tension measuring device and controlling the winch or crane system according to the changes in tension in the lift wire, so as to stabilise the load.

According to the first aspect of the present invention, there is also provided a method of heave compensation for a winch or crane system, the winch or crane system including a lift wire, the method comprising the steps of:— measuring the tension in the lift wire; and adjusting the pay out or recovery of the lift wire to compensate for the changes in the measured tension.

In the first aspect, the apparatus optionally includes a load motion measurement device for measuring the motion of the load, and the control device is capable of receiving an output from the load motion measurement device and controlling the winch or crane system according to the movement of the load.

Also in the first aspect, where the winch or crane system is provided on a vessel, the apparatus optionally includes a vessel motion measurement device for measuring the motion of the vessel, and the control device is capable of receiving an output from the vessel motion measurement device and controlling the winch or crane system according to the movement of the vessel.

Also in the first aspect, where the winch or crane system is provided on a vessel, the apparatus preferably comprises a lift wire distance measurement device which measures the length of lift wire that has been paid out.

According to a second aspect of the present invention, there is provided heave compensation apparatus for a winch or crane system, the winch or crane system including a lift wire for attachment to a load, the apparatus comprising:— a load motion measurement device for measuring the motion of the load, and a control device capable of receiving an output from the load motion measurement device and controlling the winch or crane system according to the movement of the load, so as to stabilise the load.

According to the second aspect of the present invention, there is also provided a method of heave compensation for a winch or crane system, the winch or crane system including a lift wire, the method comprising the steps of:— monitoring the movement of a load suspended by the lift wire; and adjusting the pay out or recovery of the lift wire to compensate for the movement of the load.

Also in the second aspect, where the winch or crane system is provided on a vessel, the apparatus optionally includes a vessel motion measurement device for measuring the motion of the vessel, and the control device is capable of receiving an output from the vessel motion measurement device and controlling the winch or crane system according to the movement of the vessel.

Also in the second aspect, where the winch or crane system is provided on a vessel, the apparatus preferably comprises a lift wire distance measurement device which measures the length of lift wire that has been paid out.

Also in the second aspect, where the winch or crane system is provided on a vessel, the apparatus optionally includes a lift wire tension measuring device for measuring the tension in the lift wire.

According to a third aspect of the present invention, there is provided heave compensation apparatus for a winch or crane system, the winch or crane system including a lift wire for attachment to a load, the apparatus comprising:— a lift wire distance measurement device which measures the length of lift wire that has been paid out, and a control device capable of receiving an output from the lift wire distance measurement device and controlling the winch or crane system according to the distance measured, so as to stabilise the load.

According to the third aspect of the present invention, there is also provided a method of heave compensation for a winch or crane system, the winch or crane system including a lift wire, the method comprising the steps of:— measuring the length of lift wire paid out; and adjusting the pay out or recovery of the lift wire to stabilise the load.

According to a fourth aspect of the present invention, there is provided heave compensation apparatus for a winch or crane system, the winch or crane system being provided on a vessel and including a lift wire for attachment to a load, the apparatus comprising:— a vessel motion measurement device for measuring the motion of the vessel;

and a control device capable of receiving an output from the vessel motion measurement device and controlling the winch or crane system according to the movement of the vessel, so as to stabilise the load;

wherein the apparatus further comprises at least one of:— a) a lift wire tension measuring device for measuring the tension in the lift wire;

b) a lift wire distance measurement device which measures the length of lift wire that has been paid out; and c) a load motion measurement device for measuring the motion of the load.

According to the fourth aspect of the present invention, there is also provided a method of heave compensation for a winch or crane system provided on a vessel, the winch or crane system including a lift wire, the method comprising the steps of:— monitoring the motion of the vessel and controlling the winch or crane system according to the movement of the vessel by adjusting the pay out or recovery of the lift wire to stabilise the load;

and further comprising at least one of the following steps:— a) measuring the tension in the lift wire;

b) measuring the length of lift wire that has been paid out; and c) measuring the motion of the load.

Preferably, the lift wire tension measuring device is capable of monitoring changes in the tension on the lift wire.

The apparatus typically includes a rotatable member that diverts the lift wire towards the seabed. The rotatable member, which may be a sheave, is typically rotatably mounted on a frame by the load measuring device, which may be a load pin.

The lift wire tension measuring device typically monitors the change in tension on the load pin. Thus, the changes in the tension in the lift wire can be determined by monitoring the change in tension on the load pin.

In an alternative embodiment, the lift wire tension measuring device can be configured to measure the in-line loads in the lift wire. For example, the load measuring device can be coupled to the winch or crane system so that the tension in the lift wire can be monitored directly (e.g. using load cells or the like located at the point where the winch is secured to the vessel).

The vessel motion measurement device typically comprises a motion reference unit. The load motion measurement device typically comprises a motion reference unit which is optionally coupled to the load.

In certain embodiments, the load motion measuring device is electrically coupled to the control device. In alternative embodiments, the load motion measuring device is coupled to the control device using fibre optics or any other transmission system.

The control device typically comprises a control computer. The control device is typically coupled to the drive unit for the winch or crane system. Thus, the control device can, in addition to controlling the pay out and recovery of the lift wire in response to inputs from the human operator, the control device can also control the pay out and recovery of the lift wire in response to the output from any of the following:— the lift wire tension measuring device; and/or the vessel motion measurement device; and/or the load motion measurement device; and/or a lift wire distance measurement device.

For example, where the output of the lift wire tension measuring device indicates that the tension in the lift wire is increasing, the control device typically pays out wire in order to reduce the tension. Where the output of the lift wire tension measuring device indicates that the tension in the lift wire is decreasing, the control device typically recovers wire in order to increase the tension. The sequence of pay out and recovery operations typically attenuates the tension in the lift wire. Alternatively, or additionally, the sequence of pay out and recovery operations typically attenuates the stretch of the lift wire. This has the advantage that excess energy in the crane or winch system is avoided, which in turn leads to a more stable load.

For example, where the output of the load motion reference unit indicates that the load is moving so that the tension in the lift wire would increase, the control device typically pays out wire in order to maintain the tension at a level necessary to prevent such load movement. Where the output of the load motion reference unit indicates that the load is moving so that the tension in the lift wire would decrease, the control device typically recovers wire in order to maintain the tension at a level necessary to prevent such load movement. The increase or decrease in tension typically avoids any excess energy in the system, thereby stabilising the load and avoiding any unwanted movement thereof.

Alternatively, or additionally, where the output of the load motion reference unit indicates that the load is moving so that the stretch of the lift wire would increase, the control device typically pays out wire in order to maintain the stretch at a level necessary to prevent such load movement. Where the output of the load motion reference unit indicates that the load is moving so that the stretch of the lift wire would decrease, the control device typically recovers wire in order to maintain the stretch at a level necessary to prevent such load movement. The increase or decrease in stretch typically avoids any excess energy in the system, thereby stabilising the load and avoiding any unwanted movement thereof.

The control device is typically provided with a plurality of inputs. A first input comprises a signal from a lift wire distance measurement device. The lift wire distance measurement device typically measures the length of lift wire that has been paid out. In certain embodiments, the length of wire paid out is used to determine the elasticity of the given length of the lift wire. The given length of the lift wire typically forms a second input to the control device. The control device typically calculates the elasticity of the lift wire from the length of wire paid out, typically by reference to its elasticity characteristics. An operator typically inputs this reference data into the control device before commencing a lift operation.

A third input comprises a signal from a vessel motion reference unit provided on the vessel. Thus, the control device is provided with an indication of the movement of the vessel.

In certain embodiments, an effective mass of the load typically forms an input, such as a fourth input, to the control computer. The effective mass of the load typically comprises a mass of the load itself, an added mass, and drag loads. The mass of the load itself is typically deduced from the weight and buoyancy of the load. The added mass of the load is typically deduced from the amount of water that is required to be moved with the load. The drag load is typically deduced from the drag characteristics of the load in the direction of motion thereof. An operator typically inputs this reference data into the control device before commencing a lift operation.

In certain embodiments, a vessel motion reference unit can optionally be provided, to measure vessel movements. In this embodiment, an output from the vessel motion reference unit typically forms an input, such as a fifth input, to the control computer.

In certain embodiments, a load measuring device, which may be in the form of a lift wire tension measurement device, can optionally be provided. In this embodiment, an output from the lift wire tension measurement device typically forms an input, such as a sixth input, to the control computer.

In the method according to the first aspect of the present invention, the step of monitoring changes in the tension applied to the lift wire typically comprises the step of receiving an output from a lift wire tension measurement device indicative of the changes in the tension.

Also in the method according to the first aspect of the present invention, the lift wire is typically paid out when the tension in the lift wire increases, and the lift wire is typically recovered when the tension in the lift wire decreases, in order to attenuate natural resonance effects of the lift wire.

In the method according to the fourth aspect of the present invention, the step of monitoring movement of a load suspended from the lift wire typically comprises the step of receiving an output from a load motion reference device that is indicative of the movement of the load.

Also in the method according to the fourth aspect of the present invention, the lift wire is typically paid out when the movement of the load is such that the tension in the lift wire increases, and the lift wire is typically recovered when the movement of the load is such that the tension in the lift wire decreases.

The apparatus is particularly suited for use on board vessels, such as seagoing vessels, but is not limited to such use.

BRIEF DESCRIPTION OF THE SEVERAL VIEWS OF THE DRAWINGS

Embodiments of the present invention shall now be described, by way of example only, and with reference to the accompanying drawings, in which:—

DETAILED DESCRIPTION OF THE INVENTION

Figure 1:
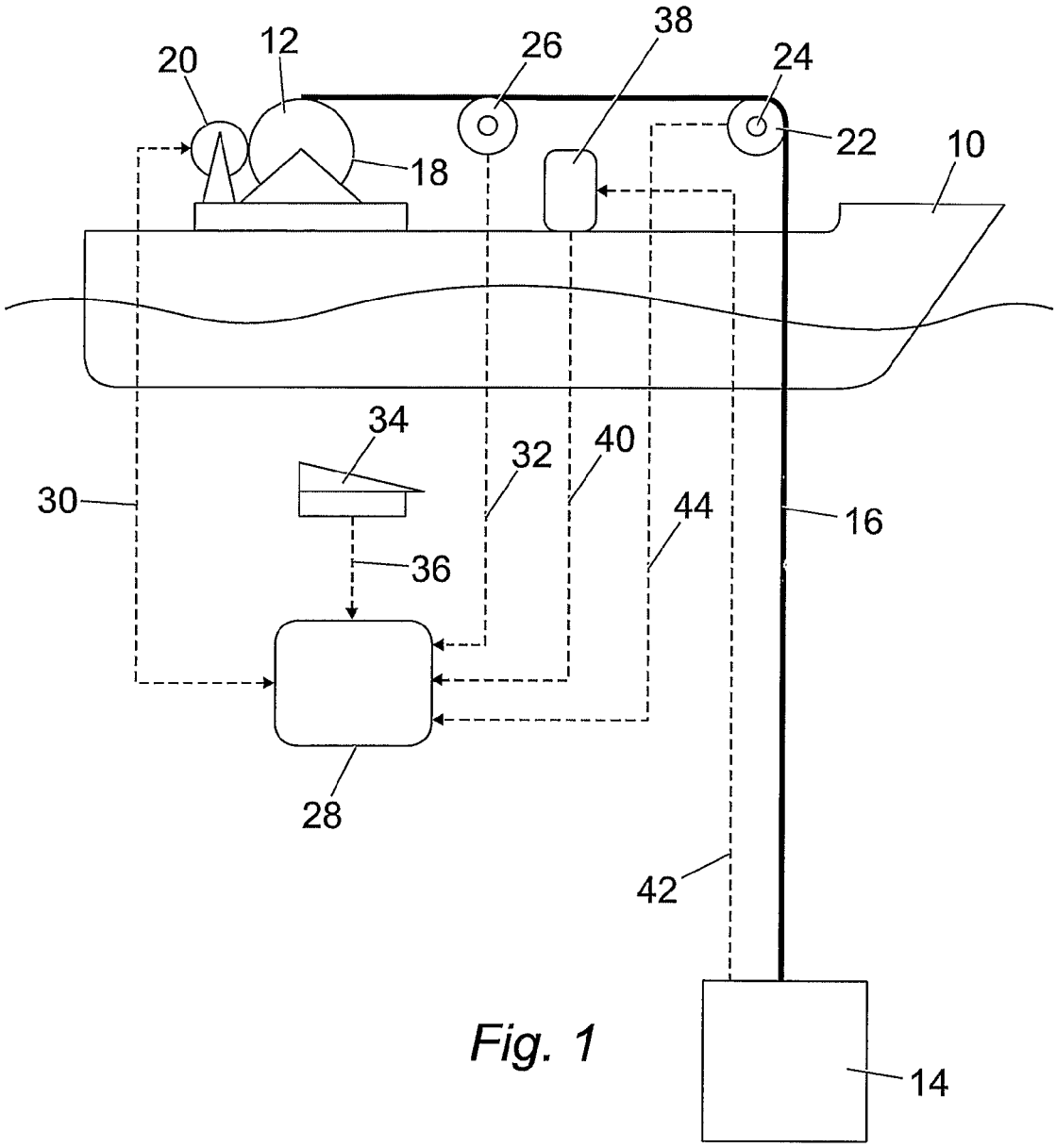
FIG. 1 is a schematic representation of a vessel provided with a particular embodiment of heave compensation apparatus.

Referring now to the drawings, FIG. 1 schematically shows an exemplary embodiment of heave compensation apparatus provided on a surface vessel 10. In this embodiment, the vessel 10 is provided with a winch 12 to facilitate lowering a load 14 to a particular depth in the water such as the seabed (not shown) or raising the load 14 therefrom.

It should be noted that the term "seabed" as used herein will be understood to refer to any underwater bed (e.g. a lake bed, river bed etc.).

It should also be noted that the load 14 need not be lowered direct to the seabed. In some cases, the load 14 may be lowered onto or raised from other underwater locations, for example apparatus and equipment such as wellheads, manifolds and the like.

Also, the particular embodiment described herein refers to the use of a winch 12. However, a crane or other lifting apparatus could be provided in place of the winch 12, and embodiments of the present invention can be used with these and other variations also.

The load 14 is attached to the winch 12 using a lift wire 16. The lift wire 16 is conventionally reeled onto a winch drum 18 forming part of the winch 12. The lift wire 16 is paid out and recovered by turning the winch drum 16, which is typically accomplished using a winch drive 20. In certain embodiments, a tension control device can optionally be interposed between the winch 12 and an over-boarding sheave 22.

The lift wire 16 can take many different forms, and need not be a steel wire since the lift wire 16 may comprise steel cable, braided cable, rope, fibre rope etc. The term "lift wire" as used herein is to be understood to refer to all of these and other variations.

The skilled reader will realise that stabilising the load 14 in accordance with embodiments of the present invention requires that, at any given time, the crane or winch 12 control system 28 can determine the potential effects of a mix of operator commands, vessel motion and lift wire 16 resonance on the position of the load 14 relative to where the operator requires the load 14 to be positioned. The control system 28 described herein can thus command the winch 12 to react (i.e. hold/pay out/recover lift wire 16) so as to move the load 14 as commanded by the operator, whilst simultaneously compensating for vessel 10 motion and inhibiting lift wire 16 resonance, thus enabling full control of the load 14 at all times.

Optionally, the data available for the operation of the control system 28, can be augmented by information on the actual movement of the load 14 by means of the output of a load motion reference unit 154.

The skilled reader will also realise that such a control system 28 will use adaptive/predictive control techniques.

The process of command, control, and stabilisation outlined above, comprises a mix of inputs and outputs depending on the situation being addressed at any one time (e.g. the vessel 10 may be moving down requiring lift wire 16 to be recovered, whilst the load 14 is moving down requiring lift wire 16 to be paid out to avoid resonance). The control process is however made up of four basic elements which are applied in varying ways by software provided in the control system 28 as the situation demands. These are:

Wire Resonance Control: lift wire 16 paid out/recovered/held as determined by the control system 28 software using inputs from the wire tension 24 and payout 26 transducers. The underlying control aim is to minimise lift wire 16 tension above or below that imposed by the need to support the load 14 itself (i.e. lift wire 16 stretch) so as to inhibit a build up of spring energy (i.e. resonant effects) in the lift wire 16.

Compensation for Vessel Motion: lift wire 16 paid out/recovered/held as determined by the control system 28 software using vessel 10 motion inputs from a vessel Motion Reference Unit 38. The underlying control aim is to minimise unwanted or uncommanded load 14 movement.

Compensation for Load Movement (optional): lift wire 16 paid out/recovered/held as determined by the control system 28 software using load motion inputs from a load Motion Reference Unit. The underlying control is again to minimise unwanted or uncommanded load 14 movement.

Operator Commands: lift wire 16 paid out/recovered/held as directed by the operator. The control system 28 software will integrate these particular operator commands with those needed to meet the load stabilisation demands as described above, so that the load 14 is moving as directed, but is under full operator control at all times, largely independent of the effects of vessel 10 motion, or lift wire 16 resonance.

The arrangement of embodiments in accordance with the various aspects of the present invention will now be described in more detail.

The lift wire 16 extends from the winch 12 over the sheave 22, which diverts the wire 16 towards the seabed. The sheave 22 is conventional in the art and is typically a pulley wheel with a grooved rim, mounted in a frame (not shown) located on the vessel 10. The sheave 22 is mounted on the frame by a load pin 24 so that the sheave 22 may rotate relative to the frame if desired.

A wire length indicator 26 (e.g. an encoder) is provided in the path of the lift wire 16, and is typically formed by an idler sheave that is rotated with the movement of the lift wire 16 as it is paid out and recovered. In some embodiments, the indicator 26 may form part of the winch 12. The wire length indicator 26 is typically used to inform an operator of the winch system of the approximate length of wire 16 that has been paid out (e.g. the approximate length of the lift wire 16 to the load 14). The output of the indicator 26 also forms an input to a control computer 28, the output being used to calculate the elasticity of the length of the paid out wire 16. The output can be coupled direct to the control computer 28 if the output of the indicator 26 and the input to the control computer 28 are compatible.

The control computer 28 is used to control the winch drive 20 and thus the rate at which the lift wire 16 is paid out and recovered. The control computer 28 is electrically linked to the winch drive 20 by a cable 30 or other transmission system, and can respond automatically to control operation of the winch 12 in response to certain variables including an output from the wire length indicator 26 (via a cable 32) or from operator input at a control console 34 electrically coupled to the control computer 28 via a cable 36. The control console 34 is typically located on-board the vessel 10. Accordingly, if the operator pushes a lever, button or other suitable man-machine interface (MMI), provided on the control console 34, the control computer accepts such commands and instructs the winch drive 20 to pay out or reel in the lift wire 16 as instructed.

The vessel 10 can be provided with a conventional Motion Reference Unit (MRU) 38 that provides feedback to the control computer 28 (via cable 40) so that the heave motion of the vessel 10 can be compensated for. The MRU 38 typically measures the motion of the vessel 10 relative to an average datum and provides, generally in a processed form, control signals that drive a heave compensator (not shown) in the correct direction by the correct amount. The heave compensation of the winch 12 overlays the normal input commands from an operator to lift, lower or hold the load 14. Accordingly, the motion experienced by the load 14 due to the heave motion experienced by the heave of the vessel 10 can be compensated for, as is conventional in the art.

Optionally, the control computer 28 can be provided with input from a load motion sensor unit (not shown but could be a further MRU) attached to the load 14, as indicated by optional cable 42. This latter embodiment is discussed in more detail with reference to FIG. 2.

In the embodiment shown in FIG. 1, and in accordance with various aspects of the present invention, the motion of the load 14 can be detected by monitoring the forces applied at the load pin 24 of the sheave 22 caused by the reactions of the load 14 to the applied vessel motion. The load at the load pin 24 is typically monitored using a tension gauge so that the tension on the lift wire 16 caused by the reactions of the load 14 can be monitored at the load pin 24. Monitoring the load at the load pin 24 is convenient, but the invention is not limited to this embodiment only. The load at the top of the lift wire 16 can be monitored using any conventional means. Accordingly, the resonance effects experienced by the load 14 due to the elasticity in the lift wire 16 can also be compensated for (in addition to the conventional heave compensation which is also provided for).

The information from the gauge at the load pin 24 is fed to the control computer 28 via a cable 44. This has the advantage of monitoring the movement of the load 14 as manifested at the top of the lift wire 16, thus giving the control computer 28 information about the dynamic state and responses of the winch system. The dynamic state and response of the winch system would include any resonant behaviour of the lift wire 16, particularly at increased depths, and the elasticity of the lift wire 16, which has an effect on the resonant behaviour of the lift wire 16.

The control computer 28 generally requires information on the configuration of the winch system. For example, the mass of the load 14 would form an input to the control computer 28. The mass of the load 14 comprises three distinct components; the first is the mass of the load 14 itself, which can be deduced from the weight of the load 14; the second component is the added mass provided by the water around the load 14 that is required to be moved in order for the load 14 to be moved; and the third component is the drag characteristics of the load 14 in the direction of the motion of the load 14—this is typically a function of the water plane area and surface area of the load 14 that is in contact with the sea in the direction of motion of the load 14. The mass, added mass and drag characteristics can be input by the winch operator using the control console 34. The control computer 28 is generally provided with a man-machine interface (MMI), e.g. in the form of the console 34 so that these, and any other required data, can be input to the computer 28.

The control computer 28 can be provided with pre-loaded reference data (e.g. look-up tables or the like) detailing, for a range of conditions, certain characteristics (e.g. dynamic, spring, drag, damping etc.) of the vessel 10, the load 14, the lift wire 16 and the winch system.

The pre-lift operator inputs define the actual vessel, hoist system, load and any other pertinent parameters.

The control computer 28 is provided with appropriate software that can take account of outputs relating to the mass of the load 14, the length of the lift wire 16 paid out as well as motions of the vessel 10 and the behaviour of the heave compensation system. In certain embodiments, the control software can apply adaptive and/or predictive control techniques.

The control software takes all of the data that is input and uses it to generate some of the control parameters required to achieve compensation so that unwanted movement of the load 14 is compensated for, and in particular, monitors the spring characteristics of the winch system.

The adaptive/predictive techniques built into the software facilitate comparison of the resultant movement of the load 14 from the commands of the operator with the actual movement of the load 14, and makes adjustments to the software parameters so that the compensation technique will "learn" and improve with use. For example, the pre-loaded data and operator inputs result from a number of different sources, each with inherent inaccuracies of varying degree, and the software can correct these parameters based on actual results. Other control techniques may also be used to predict the motion of the load 14.

The elasticity of the lift wire 16 would form another input to the control computer 28, and this is deduced from the length of the lift wire 16 that is paid out, and also the wire spring characteristics or stiffness. The length of the wire 16 that has been paid out is fed to the computer 28 from the wire length indicator 26 via cable 32, and thus the elasticity of the wire 16 can be calculated in a known manner.

The control computer 28, using appropriate software, takes the inputs from the operator of the winch 12, and from the wire length indicator 26, the MRU 38 and the load pin 24, and controls the movement of the winch 12 and thus the load 14 by paying out and recovering the lift wire 16 in order to compensate for the resonant behaviour of the system and motion of the vessel 10.

When the operator of the winch 12 commands movement of the load 14 (e.g. by operation of a joystick provided on the control console 34), then the control computer 28 would provide for motion of the winch 12 by facilitating a sequence of pay out and recovery operations of the wire 16 so that the excess energy that would otherwise have been caused by movement of the load 14 is avoided, thus stabilising the load 14 in any operating condition at any depth. This would cause the position of the load 14 to be changed without introducing oscillations to the load 14. The stabilisation of the load 14 is applied whether the load 14 is intended to be held stationary, or is being lifted or lowered.

At resonance of the wire 16 (i.e. when the lift wire 16 extends to a length sufficient to cause resonant behaviour, the system monitors the tension on the wire 16 at the load pin 24, and the control computer 28 commands the winch 12 to either pay out the wire 16 when the tension thereon increases, or recover the wire 16 as the tension thereon decreases, in order to stabilise the load 14 and is again applied whether the load 14 is intended to be held stationary or is being lifted or lowered. The increase and decrease in tension is due to the movement of the load 14 (and/or the vessel 10) that causes the lift wire 16 to extend or retract, depending upon the direction of movement of the load 14 (and/or the vessel 10). The sequence of pay out and recovery avoids build-up of excess energy in the system and thus prevents a build-up in the motion of the load 14 (i.e. when the load 14 is being lowered). Additionally, or alternatively, the sequence of pay out and recovery avoids build-up of a deficit in the energy in the system and thus prevents a build-up in the motion of the load 14 (i.e. when the load 14 is being lifted). This, in turn, effectively eliminates the resonant behaviour of the lift wire 16 and the load 14.

Thus, if the load 14 moves downwardly due to resonant behaviour of the lift wire 16, the wire 16 is further stretched causing the tension on the load pin 24 to increase, and thus the winch 12 is actuated to pay out more wire 16 in order to compensate for the increase in tension caused by the downward movement of the load 14. Conversely, if the load 14 moves upwardly due to resonant behaviour of the lift wire 16, the wire 16 contracts and the tension on the load pin 24 decreases, and thus the winch 12 is actuated to recover more wire 16 in order to compensate for the decrease in the tension caused by the upward movement of the load 14.

At the bottom (i.e. when the load 14 is near the seabed), the winch 12 is commanded to move the load 14 in such a way as to lower the load 14 without causing vertical oscillations. This control is provided by monitoring the tension on the wire 16 at the load pin 24, and adjusting the pay out and recovery of the wire 16 as described above, whilst still lowering the load 14.

Thus, monitoring of the load at the load pin 24 provides an early indication of the movement of the load 14 due to resonant behaviour of the lift wire 16 and the load pin data output can be fed back to the control computer 28, which in turn can then eliminate and/or attenuate the unwanted resonant movement.

The control software facilitates the movement and position of the load 14 to be known and controlled more accurately in response to operator input, taking into account the dynamics of the winch system including the winch 12, the lift wire 16 and the suspended load 14, and the control software uses an adaptive control algorithm to achieve stabilisation of the load 14. The information provided by the gauge at the load pin 24 may be delayed due to the dynamics of the lift wire 16, but the software can be configured to compensate for the control of parameters (i.e. the tension in the lift wire 16) that may not be measured or monitored direct.

Figure 2:
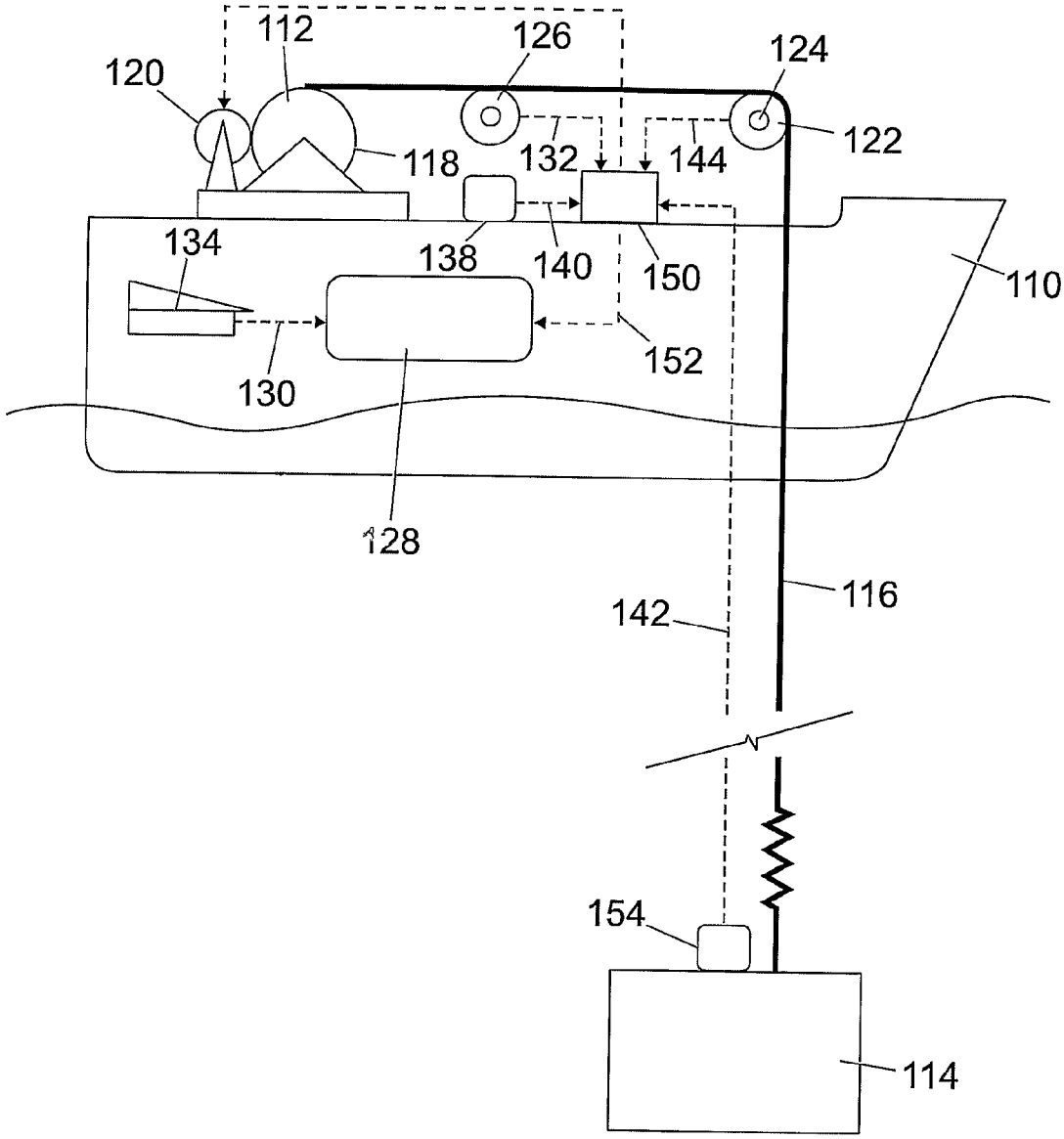
FIG. 2 is a schematic representation of a vessel provided with an alternative embodiment of heave compensation apparatus.

FIG. 2 shows an alternative embodiment that is similar to FIG. 1. Like reference numerals have been used to designate like components, prefixed "1".

In the FIG. 2 embodiment, a junction box 150 is provided on the vessel 110, and the cables 132, 140 and 144 from the wire length indicator 126, the MRU 138 and the load pin 124 are joined at the junction box 150. A two-way cable 152 provides two-way communication to and from the junction box 150 to the control computer 128. Thus, the inputs from the indicator 126, the MRU 138 and the load pin 124 are transferred to the control computer 128 via the cable 152. Control signals from the control computer 128 to the winch drive 120 are routed through the control cable 152, the junction box 150 and the control cable 130.

Also in the embodiment of FIG. 2, a load motion reference unit 154 is provided on the load 114. Thus, the load MRU 154 outputs a signal indicative of the motion of the load 114. The signal is conveyed to the control computer 128 via cable 142, junction box 150 and the cable 152.

The cable 142 can be separate from the lift wire 116 or integral therewith (e.g. by use of an umbilical).

The signal from the load MRU 154 is used in place of (or as in FIG. 2 in addition to) information on the tension in the lift wire 116 to allow the control computer 128 to compensate for the movement of the load 114 due to resonant behaviour of the lift wire 116. Thus, if the load 114 moves downwardly due to resonant behaviour of the lift wire 16, as indicated by the load MRU 154 (and/or the load on the load pin 124), the winch 112 is actuated to pay out more wire 116 in order to compensate for the unwanted downward movement of the load 114. Conversely, if the load 114 moves upwardly due to resonant behaviour of the lift wire 16, as indicated by the load MRU 154 (and/or the load on the load pin 124), the winch 112 is actuated to recover more wire 116 in order to compensate for the unwanted upward movement of the load 114.

In this particular embodiment, the approach to resonance damping detects variations in the tension on the lift wire 116, and generally separates out the effects on the load 114 caused by resonance. The information from the indicator 126 and from the load MRU 154 are converted into adjustments of the wire length (e.g. to adjust the tension in the lift wire 116) so as to neutralise or dampen the resonance behaviour of the load 114. This keeps the load 114 stable as the strain energy in the lift wire 116 neither increases nor decreases (i.e. is not in excess or deficit), and consequently, cannot induce resonance in the load 114. The damping process overlays the basic operator commands to the winch 112 (i.e. to lift, lower or hold the load 114).

In general, it is preferable for the system to take account of all the ongoing influences on rope tension and the position of the load, including, but not limited to, resonance, heave compensation actions and operator commands to lift, lower and hold the load 114. The software on the control computer 128 processes data obtained from these influences to prevent unwanted movement of the load 114 when it is being held, lifted or lowered. This leads to the load 114 moving in the way anticipated and expected by the operator, without any undue influence from the motion of the vessel 110 or resonance of the lift wire 116.

The FIG. 2 embodiment has the advantage that it reduces the requirement for predictive/adaptive capabilities in the software as it provides information on the actual load movement versus the anticipated load movement using the load MRU 154.

Figure 3:
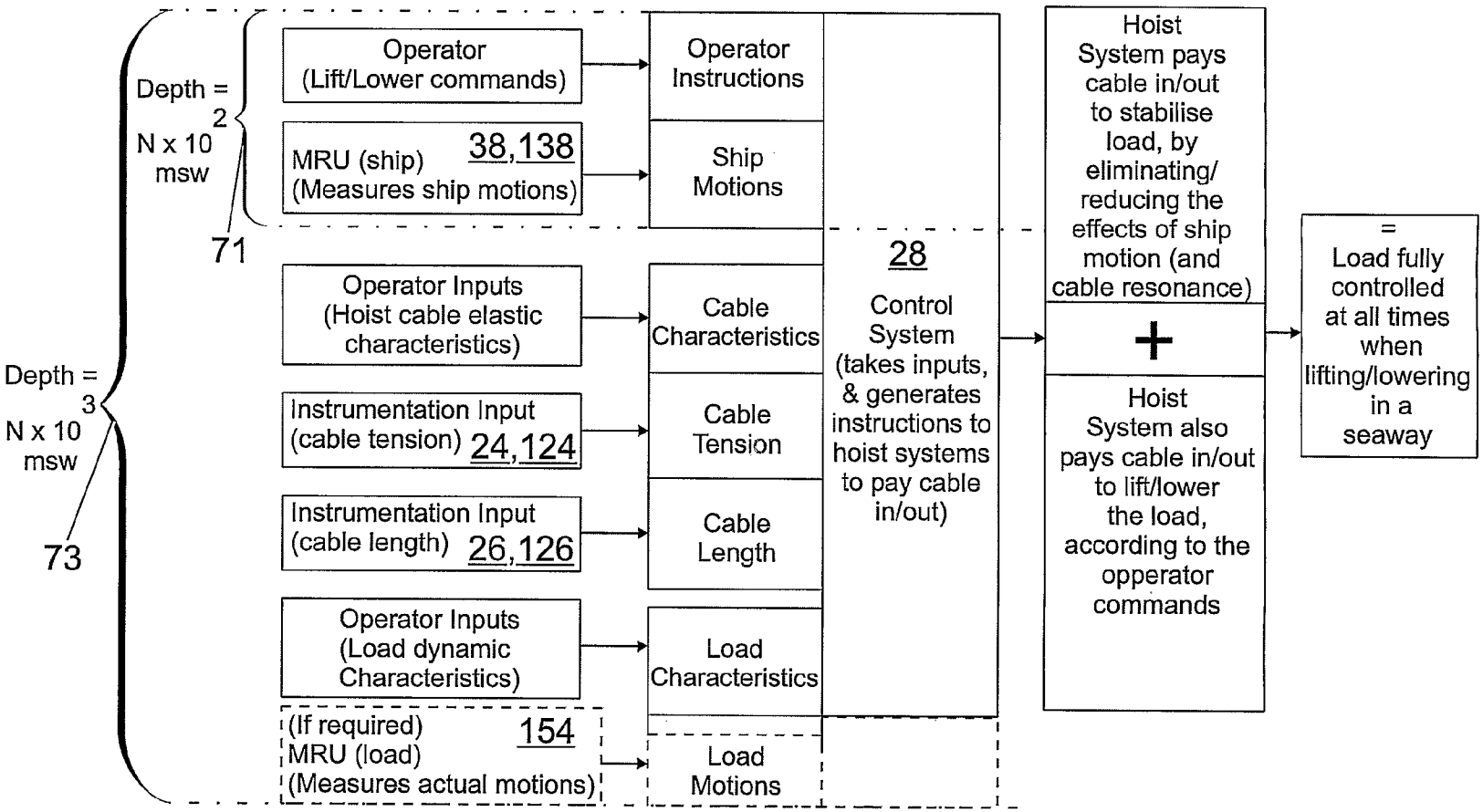
FIG. 3 is a block diagram of outline control requirements for embodiments of the present invention.

FIG. 3 shows in block diagram the inputs into the control computer 28 for two different scenarios of operation:—

Depth=$N\times10^2$ metres of water (e.g. up to a few hundred meters of water depth) and is indicated by reference numeral 71; and Depth=$N\times10^3$ metres of water (e.g. thousands of meters of water depth) and is indicated by reference numeral 73.

In shallower water (i.e. depth 71) only the operator commands (lift or lower) and the vessel heave motion reference unit inputs 38; 138 are required by the control computer because there are no apparent resonant effects exhibited by the lift wire 16. Thus the system in this mode of operation can be considered to be operating like a conventional heave compensation system since no resonance effects due to elasticity of the lift wire 16 need be compensated for since they are so minimal or non-apparent.

However, in deeper water (i.e. depth 73) the operator commands (lift or lower) and the vessel heave motion reference unit inputs 38; 138 are input into the control computer along with the additional inputs shown in FIG. 3 in order that the control computer can attenuate the resonant effects exhibited by the lift wire 16.

Embodiments of the present invention offer advantages over conventional heave compensation techniques, in that the load can be stabilised in any operating condition at any depth.

Certain embodiments of the present invention extend the function of the control system for the winch or crane so that the problems associated with the resonant behaviour and/or oscillating response of the suspended load are minimised or overcome.

Certain embodiments of the present invention provide for adjustment of the pay out and recovery of the lift wire by referring to the motion of the load itself that is suspended by the lift wire.

Certain embodiments take account of the actual movement of the load and compensate for this by control of the winch. Certain embodiments of the present invention provide a heave compensation system that models the dynamics of the whole system, including the winch, the lift wire and the load itself.

Certain embodiments of the present invention offer a heave compensation system that can be used in greater water depths than conventional systems, and can also be used in shallow water and deeper water. Certain embodiments of the present invention compensate for the resonant behaviour of the load. Certain embodiments allow the operator to accurately control the height of the load by compensating for or eliminating oscillations in the movement of the load caused by movement of the vessel.

Certain embodiments provide a system that is capable of providing safe and stable handling of loads, particularly at increased water depths when compared to conventional systems.

Certain embodiments of the present invention offer a heave compensation system that includes a system that is capable of neutralising (e.g. damping) the effects of resonance of the load. Certain embodiments are capable of neutralising the resonance effects that are already in evidence (lagging), but certain embodiments are also capable of predicting the onset of resonance and thus respond to these before they occur (leading).

Certain embodiments provide a heave compensation system and a resonance damper/neutraliser. A further system is generally included that responds to normal operator commands e.g. for the load to be lifted, lowered or remain stationary.

Modifications and improvements may be made to the foregoing without departing from the scope of the present invention. For example, the control computer has been described as being electrically coupled to various other components using electrical cables, but the couplings could be via fibre optic or other transmission or telemetry systems (e.g. by radio etc).

In a further alternative embodiment, it is possible to monitor the strain or tension on the lift wire other than by use of the load applied to the load pin. For example, an in-line strain gauge could be used to monitor the strain or tension on the lift wire direct. This could be provided at any suitable location (e.g. at the winch, the sheave etc.).

In a further modification, it will be apparent that the foregoing description refers to adjustment of the winch drive to facilitate changes in the pay out and recovery rates of the lift wire. However, a cable take-up device or other system that is capable of changing the pay out and recovery rates could be used. In one embodiment, a cable take-up device can be interposed between the winch and the over-boarding sheave. The cable length adjustments would generally be achieved electro-hydraulically, but an all-electric or other system could be used.

It should be noted that the foregoing ignores motion of the lift wire suspension point in the horizontal plane as the load is generally a considerable distance from this point. Consequently, any effects will be insignificant and/or slow and easily accommodated.

The invention claimed is:

1. A heave compensation apparatus for a winch or crane system, wherein the winch or crane system is provided on a vessel, the winch or crane system including a lift wire for attachment to a load, the apparatus comprising:

a load motion measurement device coupled to and provided on the load for measuring the motion of the load, and a control device capable of receiving an output from the load motion measurement device indicative of the movement of the load, wherein the control device controls the winch or crane system in response to said output to pay out or recover lift wire from a drum located on the vessel as required to stabilise the load.

2. A heave compensation apparatus according to claim 1, wherein the apparatus includes a vessel motion measurement device for measuring the motion of the vessel, and the control device is capable of receiving an output from the vessel motion measurement device and controlling the winch or crane system according to the movement of the vessel.

3. A heave compensation apparatus according to claim 2, further comprising a lift wire distance measurement device which measures the length of lift wire that has been paid out;

and wherein the load motion measurement device comprises a motion reference unit;

and further comprising a lift wire resonance calculation means comprising a computational means into which an operator can input data concerning the elasticity characteristics of the lift wire, wherein the computational means takes data output from the lift wire distance measurement device and calculates the elasticity of the lift wire from the length of wire paid out, by reference to its elasticity characteristics;

and wherein the control device is capable of receiving an output from the vessel motion measurement device, the load motion reference unit, the lift wire distance measurement device and the lift wire resonance calculation means;

wherein the control device controls the winch or crane system, in response to the said outputs, to payout or recover lift wire as required to stabilise the load.

4. A heave compensation apparatus according to claim 1, further comprising a lift wire distance measurement device which measures the length of lift wire that has been paid out.

5. A heave compensation apparatus according to claim 4, further comprising a lift wire resonance calculation means comprising a computational means into which an operator can input data concerning the elasticity characteristics of the lift wire, wherein the computational means takes data output from the lift wire distance measurement device and calculates the elasticity of the lift wire from the length of wire paid out, by reference to its elasticity characteristics.

6. A heave compensation apparatus according to claim 1, further comprising a lift wire tension measuring device for measuring the tension in the lift wire.

7. A heave compensation apparatus according to claim 1, wherein the load motion measurement device comprises a motion reference unit.

8. A heave compensation apparatus according to claim 1, wherein the control device comprises a control computer coupled to the drive unit for the winch or crane system.

9. A heave compensation apparatus according to claim 8, wherein the control computer comprises control software that utilises adaptive/predictive control techniques.

10. A heave compensation apparatus according to claim 1, wherein the control device is operable to control, in addition to controlling the pay out and recovery of the lift wire in response to inputs from a human operator, the pay out and recovery of the lift wire in response to the output from any of the following:

a lift wire tension measuring device; and/or a vessel motion measurement device; and/or a lift wire distance measurement device.

11. A heave compensation apparatus according to claim 1, wherein the control device calculates the elasticity of the lift wire from the length of wire paid out, by reference to its elasticity characteristics.

12. A heave compensation apparatus according to claim 1, wherein an effective mass of the load forms a further input to the control device, wherein the effective mass of the load comprises a mass of the load itself, an added mass, and drag loads.

13. A heave compensation apparatus according to claim 1, wherein the apparatus further comprises a control means to permit an operator to instruct the winch or crane system to at least raise, hold or lower the lift wire and the control device is further capable of receiving an output from the operator control means and is capable of controlling the winch or crane system in response to the said outputs.

14. A heave compensation apparatus according to claim 13, wherein the added mass of the load is deduced from the amount of water that is required to be moved with the load and the drag load is deduced from the drag characteristics of the load in the direction of motion thereof.

15. A heave compensation apparatus according to claim 1, further comprising a rotatable member that diverts the lift wire towards the seabed wherein the rotatable member is rotatably mounted on a frame by a load pin.

16. A heave compensation apparatus according to claim 15, further comprising a lift wire tension measuring device for measuring the tension in the lift wire, wherein the lift wire tension measuring device monitors the change in tension on the load pin such that changes in the tension in the lift wire are determined by monitoring the change in tension on the load pin.

17. A heave compensation apparatus according to claim 16, wherein the lift wire tension measuring device is configured to measure in-line loads in the lift wire.

18. A method of heave compensation for a winch or crane system, wherein the winch or crane system is provided on a vessel, the winch or crane system including a lift wire, the method comprising the steps of:

coupling a load motion measurement device to the load and providing it on the load;

using a control device to monitor the data output by the load motion measurement device indicative of the movement of the load suspended by the lift wire; and adjusting the pay out or recovery of the lift wire from a drum located on the vessel to compensate for the movement of the load.

19. A method according to claim 18, further comprising measuring the length of lift wire that has been paid out and inputting data indicative of the said length into the control device.

20. A method according to claim 18, further comprising measuring the motion of the vessel and inputting data indicative of the motion into the control device.

21. A method according to claim 18, further comprising measuring tension in the lift wire and inputting data indicative of the tension into the control device.

22. A method according to claim 18, further comprising inputting data concerning the elasticity characteristics of the lift wire into a computational means, and further inputting data indicative of the length of lift wire that has been paid out into the computational means and using the computational means to calculate the elasticity of the lift wire and inputting the calculated elasticity of the lift wire into the control device.

23. A method according to claim 18, further comprising using the control device to control the vessel winch or crane system in response to the said inputs, to pay out or recover lift wire as required to stabilise the load.

24. A method according to claim 18, wherein the lift wire is paid out when the movement of the load is such that the tension in the lift wire increases or is predicted by the lift wire resonance calculation means to increase, and the lift wire is recovered when the movement of the load is such that the tension in the lift wire decreases or is predicted by the lift wire resonance calculation means to decrease.

25. A method according to claim 18, further comprising providing an output from an operator control means which indicates if an operator instructs raising, holding or lowering of the lift wire.

26. A method according to claim 18, wherein an operator inputs reference data concerning the elasticity characteristics of the lift wire into the control device before commencing a lift operation.

27. A method according to claim 18, wherein an operator inputs reference data concerning the mass of the load, the added mass of the load and the drag characteristics of the load into the control device before connecting a lift operation.

28. A heave compensation apparatus for a winch or crane system, the winch or crane system being provided on a vessel and including a lift wire for attachment to a load, the apparatus comprising:

a) vessel motion measurement device for measuring the motion of the vessel;

b) a lift wire tension measuring device for measuring the tension in the lift wire;

c) a lift wire distance measurement device which measures the length of lift wire that has been paid out; and d) a lift wire resonance calculation means comprising a computational means into which an operator can input data concerning the elasticity characteristics of the lift wire, wherein the computational means takes data output from the lift wire distance measurement device and calculates the elasticity of the lift wire from the length of wire paid out, by reference to its elasticity characteristics;

the apparatus further comprising a control device capable of receiving an output from the vessel motion measurement device, the lift wire tension measuring device, the lift wire distance measurement device and the lift wire resonance calculation means;

wherein the control device controls the winch or crane system, in response to the said outputs, to payout or recover lift wire from a drum located on the vessel as required to stabilise the load.

29. A heave compensation apparatus according to claim 28, wherein the apparatus further comprises a control means to permit an operator to instruct the winch or crane system to at least raise, hold or lower the lift wire and the control device is further capable of receiving an output from the operator control means and is capable of controlling the winch or crane system in response to the said outputs.

30. A heave compensation apparatus according to claim 28, wherein the control device comprises a control computer coupled to a drive unit for the winch or crane system.

31. A heave compensation apparatus according to claim 28, wherein an effective mass of the load forms a further input to the control device, wherein the effective mass of the load comprises a mass of the load itself, an added mass, and drag loads.

32. A heave compensation apparatus according to claim 31, wherein the added mass of the load is deduced from the amount of water that is required to be moved with the load and the drag load is deduced from the drag characteristics of the load in the direction of motion thereof.

33. A heave compensation apparatus according to claim 28, further comprising a rotatable member that diverts the lift wire towards the seabed wherein the rotatable member is rotatably mounted on a frame by a load pin.

34. A heave compensation apparatus according to claim 33, wherein the lift wire tension measuring device monitors the change in tension on the load pin such that changes in the tension in the lift wire are determined by monitoring the change in tension on the load pin.

35. A heave compensation apparatus according to claim 33, wherein the lift wire tension measuring device is configured to measure in-line loads in the lift wire.

36. A method of heave compensation for a winch or crane system, the winch or crane system being provided on a vessel and including a lift wire, the method comprising the steps of:

measuring the motion of the vessel and inputting data indicative of the motion into a control device;

measuring the tension in the lift wire and inputting data indicative of the tension into the control device; and measuring the length of lift wire that has been paid out and inputting data indicative of the said length into the control device; and inputting data concerning the elasticity characteristics of the lift wire into a computational means, and further inputting data indicative of the length of lift wire that has been paid out into the computational means and using the computational means to calculate the elasticity of the lift wire and thereby provide a lift wire resonance calculation means and inputting the calculated elasticity of the lift wire into the control device; and using the control device to controlling the vessel winch or crane system in response to the said inputs, to pay out or recovery lift wire from a drum located on the vessel as required to stabilise the load.

37. A method of heave compensation according to claim 36, wherein the lift wire is paid out when the movement of the load is such that the tension in the lift wire increases or is predicted by the lift wire resonance calculation means to increase, and the lift wire is recovered when the movement of the load is such that the tension in the lift wire decreases or is predicted by the lift wire resonance calculation means to decrease.

38. A method according to either of claim 36, further comprising providing an output from an operator control means which indicates if an operator instructs raising, holding or lowering of the lift wire.

39. A method according to claim 36, wherein an operator inputs reference data concerning the elasticity characteristics of the lift wire into the control device before commencing a lift operation.

40. A method according to claim 36, wherein an operator inputs reference data concerning the mass of the load, the added mass of the load and the drag characteristics of the load into the control device before commencing a lift operation.

* * * * *